US005551166A

United States Patent [19]

Milstead

[11] Patent Number: 5,551,166

[45] Date of Patent: Sep. 3, 1996

[54] DRYER DRUM COATER HAVING VENTED OUTER SHELL FOR VOC/$NO_x$ REDUCTION

[75] Inventor: John Milstead, Chattanooga, Tenn.

[73] Assignee: Astec Industries, Inc., Chattanooga, Tenn.

[21] Appl. No.: 206,879

[22] Filed: Mar. 7, 1994

[51] Int. Cl.[6] ..... F26B 3/00

[52] U.S. Cl. ..... 34/479; 34/131; 34/137; 432/106

[58] Field of Search ..... 34/72, 79, 86, 34/35, 478, 479, 131, 132, 140, 141; 110/226, 204; 366/25, 137, 2, 4, 7, 12, 159; 432/105, 106; 431/115

[56] References Cited

U.S. PATENT DOCUMENTS

| | | | |
|---|---|---|---|
| 2,224,544 | 12/1940 | Keller | 236/15 |
| 4,190,370 | 2/1980 | Brock et al. | 366/25 |
| 4,279,592 | 7/1981 | Grant | 432/105 |
| 4,298,287 | 11/1981 | McCarter, III et al. | 366/4 |
| 4,600,379 | 7/1986 | Elliott . | |
| 4,728,282 | 3/1988 | May | 431/9 |
| 4,892,411 | 1/1990 | Elliott et al. | 366/25 |
| 4,926,765 | 5/1990 | Dreizler et al. | 110/234 |
| 5,261,738 | 11/1993 | Brock . | |

*Primary Examiner*—Denise L. Gromada
*Assistant Examiner*—Susanne C. Tinker
*Attorney, Agent, or Firm*—Nilles & Nilles, S.C.

[57] ABSTRACT

A dryer drum coater reduces blue smoke emissions by evacuating the blue smoke from the dryer drum coater independently of the exhaust of combustion products. The blue smoke, produced when heated and dried aggregate is mixed with other asphaltic products such as RAP or liquid asphalt, is preferably evacuated from a vapor outlet formed remote from the exhaust products outlet of the coater and adjacent the heated and dried aggregate inlet of the mixing chamber. Evacuating the blue smoke at this location obviates the need to separate the blue smoke from the combustion products and also prevents the introduction of excess oxygen into the combustion zone of the dryer drum coater. In a particularly preferred arrangement, the evacuated blue smoke is fed directly to the combustion air inlet of the coater's burner blower and is thereby incinerated.

17 Claims, 2 Drawing Sheets

DRYER DRUM COATER HAVING VENTED OUTER SHELL FOR VOC/$NO_x$ REDUCTION

BACKGROUND OF THE INVENTION

1. Field of the Invention

The invention relates to dryer drum coaters and, more particularly, relates to a method and apparatus for venting blue smoke, formed upon the mixing of heated and dried virgin aggregate with other asphaltic products, from the outer shell of the dryer drum coater to reduce hydrocarbon emissions.

2. Discussion of the Related Art

The mixing of recycled asphalt products (RAP) with virgin aggregate is now in wide use in the asphalt production industry. The virgin aggregate is typically first heated and dried in a rotary drum of a drum mixer or dryer drum coater and then mixed with RAP and liquid asphalt in a separate mixing chamber of the dryer drum coater to form a hot asphalt mix suitable for paving. One such dryer drum coater, manufactured by Astec Industries, Inc. and commonly known as a "double barrel dryer", is schematically illustrated in FIG. 1. The dryer drum coater 10 illustrated in FIG. 1 comprises an inner drum 12 and a fixed outer sleeve 14 mounted on a common frame 16 in an inclined manner. The inner drum 12 is rotatably mounted on the frame 16 by a plurality of bearings 18 and is driven to rotate by a suitable motor 20. A burner 22 directs a flame 24 generally axially into the interior of inner drum 12.

Inner drum 12 has at its first (upper) end 26 a virgin aggregate inlet 28 and a combustion products outlet 30, and has at its second (lower) end 32 a plurality of openings 34 forming heated and dried virgin aggregate outlets. Inner drum 12 also supports a plurality of paddles 36 extending into a mixing chamber 38 formed between the inner drum 12 and the outer sleeve 14. The interior of the inner drum 12 is functionally separated into a combustion zone located in the vicinity of the burner flame 24 and a drying zone located between the combustion zone and the first end 26 of the drum 12.

Outer sleeve 14 is separated from the inner drum 12 by a sufficient distance to form a mixing chamber 38 which is sufficiently wide to provide clearance for the paddles 36. Outer sleeve 14 has an upper RAP inlet 40, a virgin aggregate inlet 42 cooperating with the openings 34 of the inner drum 12, and an asphalt mix outlet 44. Outer sleeve 14 also receives suitable equipment (not shown) for injecting liquid asphalt into the mixing chamber 38.

In use, virgin aggregate is fed into the virgin aggregate inlet 28 of the inner drum 12 via a suitable conveyor 46 and is heated and dried as it travels downwardly through the inclined drum 12 counter to the direction of the flame 24 from the burner 22. Heated and dried aggregate in the second end 32 of the drum 12 falls through openings 34 in the drum 12, through the inlet 42 in the sleeve 14, and into the mixing chamber 38. RAP is simultaneously fed into mixing chamber 38 from the inlet 40 by a suitable conveyor 48 and is mixed by the paddles 36 with the heated and dried virgin aggregate. Liquid asphalt is also normally injected at this time, thereby forming an asphalt paving mix. In addition to mixing the virgin aggregate, RAP, and liquid asphalt, the paddles 36 also convey the resulting mix to the mixing chamber outlet 44, where the mix is discharged from the dryer drum coater 10. Combustion products formed during operation of the dryer drum coater 10 rise out of the inner drum 12 through outlet 30 and are conveyed to a downstream device such as a bag house.

Vapors laden with hydrocarbons and other contaminates are typically produced in the mixing chamber 38 upon the mixing of the heated and dried virgin aggregate with RAP and/or liquid asphalt. These vapors, commonly called and henceforth referred to as "blue smoke", are drawn through the openings 34 and into the interior of inner drum 12. Much of the blue smoke in the drum 12 flows laminarly along the shell of the inner drum 12 as represented by the arrows 52. A small quantity of this smoke may be entrained and incinerated by eddy currents 50 occurring naturally near the end of the flame 24. Most of the blue smoke, however, avoids contact with the eddy currents 50 due to its laminar flow and is discharged from the inner drum 12 through outlet 30 without ever contacting the burner flame 24, thereby resulting in the emissions of relatively high quantities of undesired pollutants such as VOC's, NOx, etc.

Attempts have been made to reduce blue smoke emissions from dryer drum coaters. For instance, U.S. Pat. No. 4,600,379 to Elliott ("the Elliott patent") discloses a dryer drum coater which is designed to evacuate blue smoke from the dryer drum coater and to feed the evacuated blue smoke to the combustion air inlet of the dryer's burner. The vapor inlet serving as an evacuation point is, however, located near—indeed, adjacent to—the combustion products outlet of the coater. The evacuation assembly thus must separate the blue smoke from the remaining combustion products present in the inner drum of the dryer drum coater. Such separation is according to the Elliott patent made possible by virtue of the fact that the blue smoke is heavier than the remaining combustion products and thus can be drawn off through a negative pressure conduit located beneath the exhaust conduit. The efficiency of such an arrangement is limited because the lower conduit would likely either over evacuate or under evacuate, thus either evacuating a portion of the remaining products with the blue smoke or failing to evacuate all of the blue smoke. Neither situation is desirable.

OBJECTS AND SUMMARY OF THE INVENTION

It is therefore an object of the invention to reduce the emissions of blue smoke from a dryer drum coater.

This object is preferably achieved by evacuating blue smoke directly from the mixing chamber of the coater. The method includes providing a dryer drum coater having a rotatable inner drum and an outer shell forming a mixing chamber therebetween, the inner drum having a combustion products outlet, directing a flame into the inner drum; and feeding virgin aggregate through the inner drum such that the aggregate is heated and dried by the flame. Further steps include mixing heated and dried virgin aggregate with other asphaltic products in the mixing chamber, thereby producing blue smoke, and evacuating the blue smoke from a vapor outlet of the dryer drum coater located remote from the combustion products outlet.

The evacuating step preferably comprises evacuating the blue smoke from a vapor outlet formed in an end wall of the outer shell at a location adjacent to a virgin aggregate inlet of the outer shell.

In a particularly preferred arrangement, the evacuated vapors are conveniently eliminated by feeding the evacuated vapors to a combustion air inlet of a burner supplying the flame to the inner drum.

Another object of the invention is to provide a dryer drum coater exhibiting reduced blue smoke emissions.

In accordance with another aspect of the invention, this object is achieved by providing a dryer drum coater comprising an inner rotary drum, a burner, and an outer shell. The inner drum heats and dries virgin aggregate and has a virgin aggregate inlet, a virgin aggregate outlet, and a combustion products outlet. The outer shell surrounds a portion of the drum to define a mixing chamber for mixing the heated and dried virgin aggregate with other asphaltic products. The shell has a virgin aggregate inlet connected to the virgin aggregate outlet of the inner drum, an asphalt mix outlet, and a vapor outlet located remote from the combustion products outlet of the inner drum and adjacent the virgin aggregate inlet of the outer shell. Preferably, the virgin aggregate inlet of the inner drum and the combustion products outlet are located near a first axial end of the dryer drum coater, and the vapor outlet is located near a second axial end of the dryer drum coater.

Means are also preferably provided to dispose of the evacuated vapors. To this end a ductwork assembly is provided having an inlet connected to the vapor outlet. The ductwork assembly has an outlet connected to a combustion air inlet of a burner directing a flame into the inner drum. A damper is positioned in the ductwork assembly and controls the flow of blue smoke through the ductwork assembly.

Other objects, features, and advantages of the present invention will become apparent to those skilled in the art in the following detailed description and the accompanying drawings. It should be understood, however, that the detailed description and specific examples, while indicating preferred embodiments of the present invention, are given by way of illustration and not of limitation. Many changes and modifications within the scope of the present invention may be made without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENTS

1. Resume

Pursuant to the invention, a dryer drum coater is provided which reduces blue smoke emissions by evacuating the blue smoke from the dryer drum coater independently of the exhaust of combustion products. The blue smoke, produced when heated and dried aggregate is mixed with other asphaltic products such as RAP or liquid asphalt, is preferably evacuated from a vapor outlet formed remote from the exhaust products outlet of the coater and adjacent the heated and dried aggregate inlet of the mixing chamber. Evacuating the blue smoke at this location obviates the need to separate the blue smoke from the combustion products and also prevents the introduction of excess oxygen into the combustion zone of the dryer drum coater. In a particularly preferred arrangement, the evacuated blue smoke is fed directly to the combustion air inlet of the coater's burner blower and is thereby incinerated.

2. Construction and Operation of the Dryer Drum Coater and Evacuation Assembly

Figure 1:
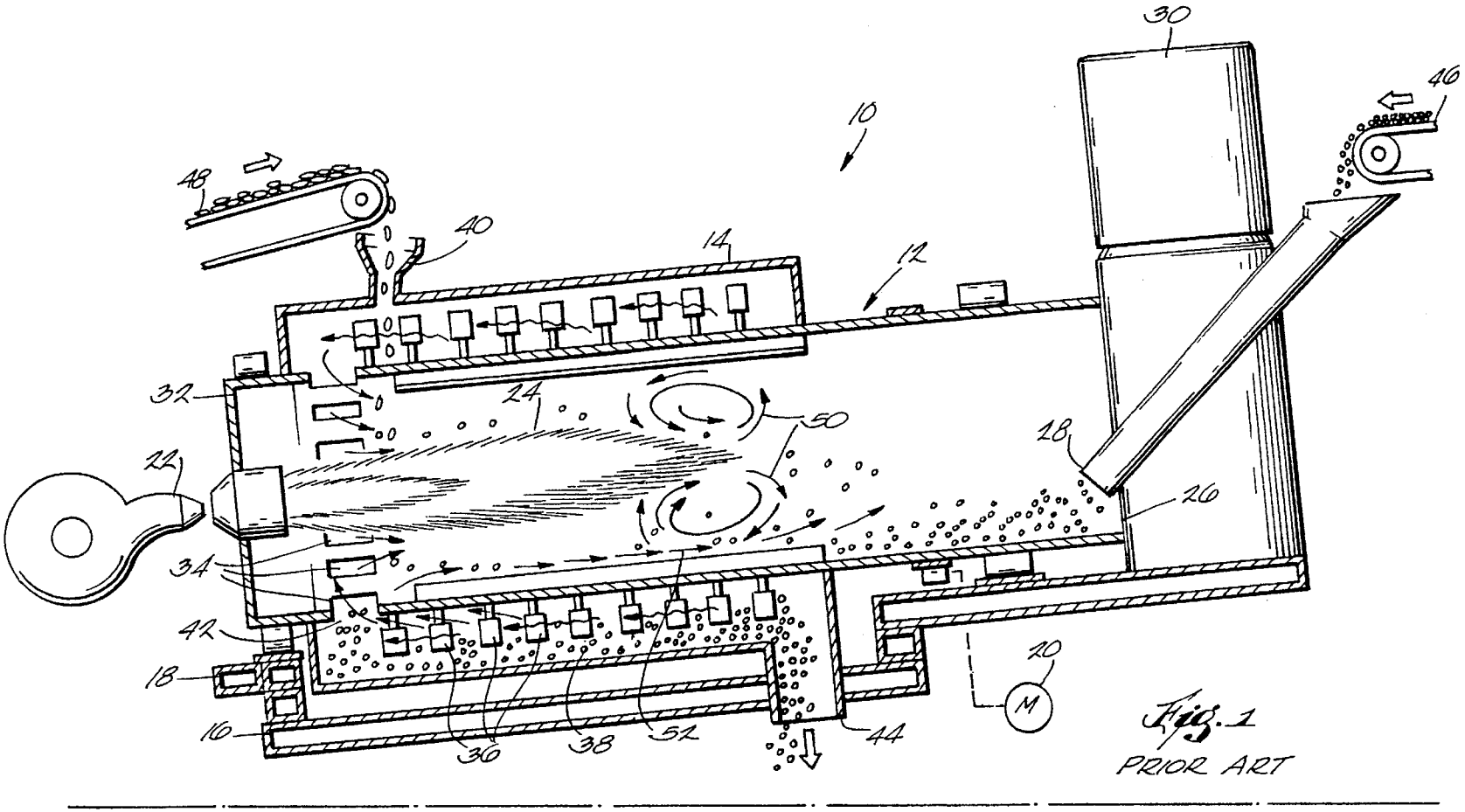
Fig. 1 PRIOR ART
FIG. 1 is a sectional side elevation view of a prior art dryer drum coater, appropriately labeled "PRIOR ART"
Figure 2:
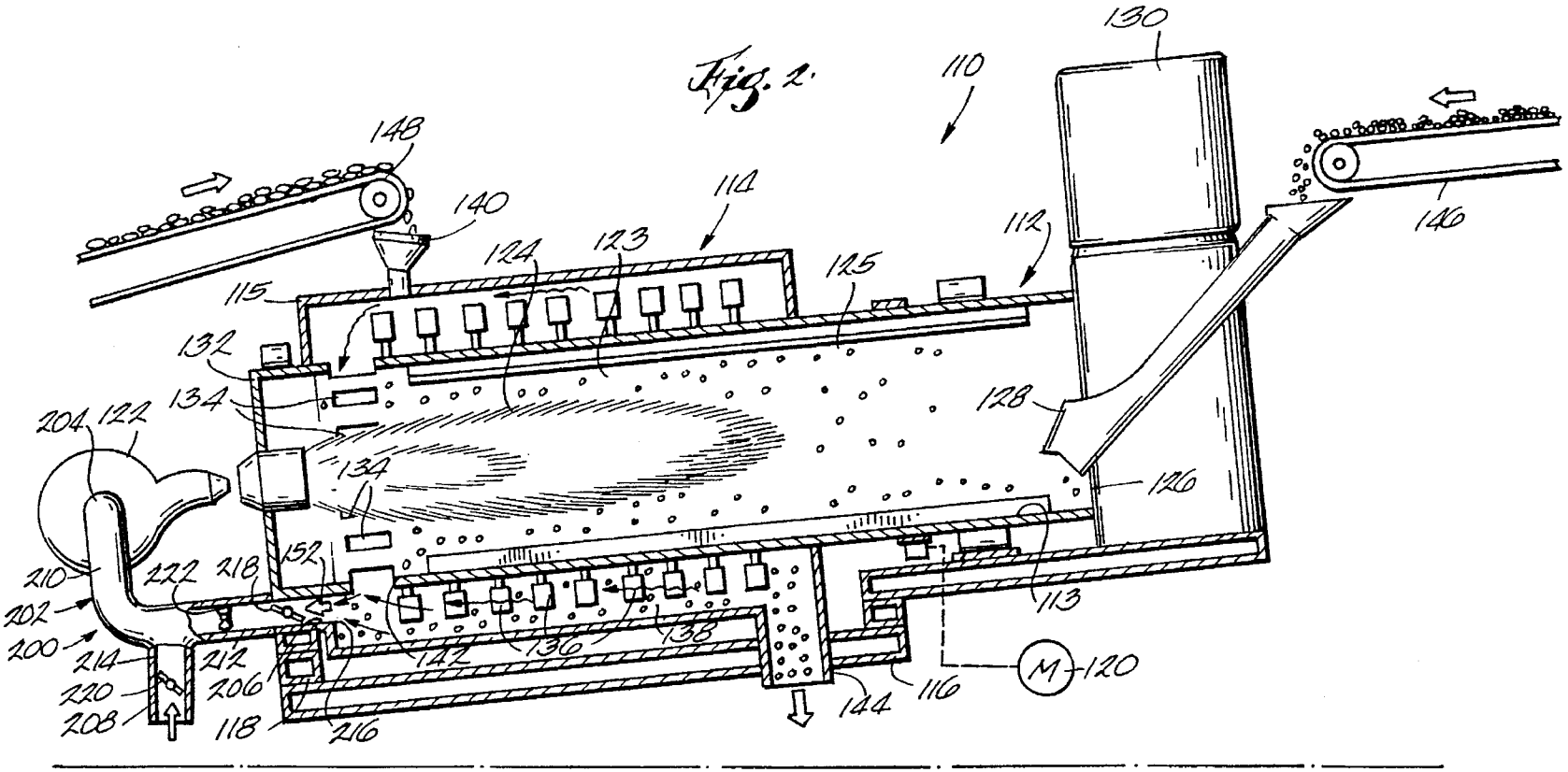
FIG. 2 is a sectional side elevation view of a dryer drum coater constructed in accordance the present invention.

Referring now to FIG. 2, a drum mixer or dryer drum coater 110 is illustrated which, except for incorporating a blue smoke evacuation assembly 200, is identical in construction to the dryer drum coater 10 of FIG. 1 and, accordingly, is denoted by the same reference numerals, incremented by 100. Dryer drum coater 110 thus includes an inner drum 112 and a fixed outer sleeve 114 mounted on a common frame 116 in an inclined manner. The inner drum 112 is rotatably mounted on the frame 116 by a plurality of bearings 118 and is driven to rotate by a suitable motor 120. A burner 122 directs a flame 124 generally axially into the interior of drum 112.

Inner drum 112 comprises a cylindrical shell 113 having at its first (upper) end 126 a virgin aggregate inlet 128 and a combustion products outlet 130, and having at its second (lower) end 132 a plurality of openings 134 forming heated and dried aggregate outlets. Inner drum 112 also supports a plurality of paddles 136 extending into a mixing chamber 138 formed between the inner drum 112 and the outer sleeve 114. The interior of the inner drum 112 is functionally separated into a combustion zone 123 located in the vicinity of the burner flame 124 and a drying zone 125 located between the combustion zone 123 and the first end 126 of the inner drum 112.

Outer sleeve 114 is separated from the inner 112 by a sufficient distance to define a mixing chamber 138 which is sufficiently wide to provide clearance for the paddles 136. Outer sleeve 114 has an upper RAP inlet 140, a virgin aggregate inlet 142 cooperating with the openings 134 of the inner drum 112, and an asphalt mix outlet 144. Outer sleeve 114 also receives suitable equipment (not shown) for injecting liquid asphalt into the mixing chamber 138.

Evacuation assembly 200 may comprise any structure adapted to evacuate blue smoke from the dryer drum coater 110, but should evacuate the blue smoke from the coater 110 at a location in which the blue smoke naturally concentrates in the absence of significant percentages of combustion products, thereby facilitating evacuation. Evacuation should also occur before the blue smoke enters the drying zone 125 of the rotary drum 112. It has been discovered that the ideal location is closely adjacent to the virgin aggregate inlet 142 of the mixing chamber 138 which would otherwise serve as a conduit for the flow of blue smoke into the inner drum 112.

Evacuation assembly 200 illustrated in FIG. 2 comprises a ductwork assembly 202 having an outlet 204 and first and second inlets 206, 208 formed in the ends of respective branch ducts 210, 212, and 214 of the ductwork assembly 202. The first inlet 206 is connected to a vapor outlet 216 formed in the end wall 115 of sleeve 114 adjacent to the virgin aggregate inlet 142, and the second inlet 208 communicates with the ambient atmosphere. Dampers 218 and 220 are provided in each of the inlet branch ducts 212 and 214 to provide a controlled flow of combustion air to the burner blower 122. Though not essential to the operation of the evacuation assembly 200, a low capacity fan or blower 222 is also preferably provided in the first inlet branch duct 212 to aid in the evacuation of blue smoke from the mixing chamber 138.

In use, virgin aggregate is fed into the virgin aggregate inlet 128 of the inclined inner rotary drum 112 via a suitable conveyor 146 and is heated and dried by heat from the burner flame 124 as it is conveyed downwardly through the drum 112 counter to the direction of the flame 124. The heated and dried aggregate empties into the outer mixing chamber 138 through the outlets 134 of drum 112 and the inlet 142 of sleeve 114. RAP is simultaneously fed into mixing chamber 138 via a conveyor 148 and RAP inlet 140 and is then mixed with the heated and dried virgin aggregate by the paddles 136. Liquid asphalt is also added to the virgin aggregate/RAP mixture to produce an asphalt mix. The asphalt mix is conveyed by the paddles 136 to the outlet 144 and discharged from the dryer drum coater 110. Combustion products formed during operation of the dryer drum coater 110 are discharged from outlet 130 and are conveyed to a bag house or the like for further treatment.

Blue smoke, formed in the mixing chamber 138 when the heated and dried virgin aggregate is mixed with RAP and liquid asphalt, is drawn towards the openings 134 of inner drum 112 due to a pressure differential between the interior of the inner drum 112 and the mixing chamber 138. Without the evacuation assembly 200, this blue smoke would normally flow into the interior of drum 112, and much would flow along the shell 113 of the inner drum 112 and out of the vapor outlet 130. However, due to the presence of evacuation assembly 200, the blue smoke is drawn out of the mixing chamber 138 through the vapor outlet 216 before it enters the inner drum 112. This not only limits the introduction of hydrocarbons into the interior of drum 112, but also inhibits the introduction of excess oxygen into the interior of drum 112 and inhibits VOC and NOx formation.

The blue smoke evacuated from vapor outlet 216 has a relatively high oxygen content and thus is suitable for use as combustion air for burner 122. The hydrocarbons and other contaminants in the blue smoke can thus be conveniently eliminated though combustion in the burner 122 after it is drawn through the inlet 206 of ductwork assembly 202, branch ducts 212 and 210, and outlet 204. The blower for the burner 122 also serves to draw blue smoke out of the mixing chamber 138, thus obviating the need for blower 222 or at least permitting the use of a very low capacity blower. Optimal flow of combustion air to the burner 122 can be maintained, despite fluctuations in blue smoke evacuation, through operation of the dampers 218 and 220.

While the evacuation assembly 200 has been described in conjunction with a "double barrel" counterflow type drum mixer or dryer drum coater, it should be understood that such an assembly could be used in virtually any dryer drum coater in which heated and dried virgin aggregate is mixed with RAP, liquid asphalt, or any other materials which may result in blue smoke emissions. The assembly 200 also need not take the form illustrated but could instead be formed from a variety of different structures. Many additional changes and modifications could be made to the present invention without departing from the spirit thereof. The scope of such changes will become apparent from a reading of the appended claims.

I claim:

1. A method of reducing hydrocarbon emissions from a dryer drum coater, said method comprising A. providing a dryer drum coater having a rotatable inner drum and an outer shell forming a mixing chamber therebetween, said inner drum having a combustion products outlet;

B. heating said inner dram;

C. feeding virgin aggregate through said inner drum and into said mixing chamber such that said virgin aggregate is heated and dried as it travels through said inner drum, said virgin aggregate being fed into a virgin aggregate inlet of said mixing chamber;

D. mixing heated and dried virgin aggregate with other asphaltic products in said mixing chamber, thereby producing blue smoke; and E. evacuating said blue smoke from a vapor outlet of said dryer drum coater located adjacent said virgin aggregate inlet of said mixing chamber and remote from said combustion products outlet.

2. A method as defined in claim 1, wherein said evacuating step comprises evacuating said blue smoke from a vapor outlet formed in an end wall of said outer shell at a location adjacent to a virgin aggregate inlet of said outer shell.

3. A method as defined in claim 1, further comprising feeding said evacuated blue smoke to a combustion air inlet of a burner supplying a flame to said inner drum.

4. A method as defined in claim 3, further comprising controlling the flow of said evacuated blue smoke to said burner via operation of a damper.

5. A method as defined in claim 1, wherein said evacuating step comprises drawing said blue smoke out of said mixing chamber via operation of a low capacity blower.

6. A method as defined in claim 1, wherein said mixing step comprises mixing heated and dried virgin aggregate with at least one of RAP and liquid asphalt.

7. A dryer drum coater comprising:

A. a rotary drum which heats and dries virgin aggregate, said rotary drum having an aggregate inlet, an aggregate outlet, and a combustion products outlet;

B. means for defining a mixing chamber for mixing heated and dried virgin aggregate with other asphaltic products, thereby producing blue smoke, wherein said mixing chamber includes a virgin aggregate inlet; and C. means for evacuating said blue smoke from a vapor outlet located adjacent said virgin aggregate inlet of said mixing chamber and remote from said combustion products outlet of said rotary drum.

8. A dryer drum coater as defined in claim 7, wherein said means for evacuating comprises a ductwork assembly having an inlet connected to said vapor outlet.

9. A dryer drum coater as defined in claim 8, wherein said ductwork assembly has an outlet connected to a combustion air inlet of a burner directing a flame into said inner drum.

10. A dryer drum coater as defined in claim 9, further comprising a damper which is positioned in said ductwork assembly and which controls the flow of blue smoke through said ductwork assembly.

11. A dryer drum coater as defined in claim 8, further comprising a blower which draws said blue smoke into said ductwork assembly.

12. A dryer drum coater comprising:

A. an inner rotary drum which heats and dries virgin aggregate, said inner drum having a virgin aggregate inlet, a virgin aggregate outlet, and a combustion products outlet;

B. a burner directing a flame into said inner drum;

C. an outer shell surrounding a portion of said inner drum to define a mixing chamber for mixing said heated and dried virgin aggregate with other asphaltic products, said shell having (1) a virgin aggregate inlet connected to said virgin aggregate outlet of said inner drum, (2) an asphalt mix outlet, and (3) a vapor outlet located remote from said combustion products outlet of said inner drum and adjacent said virgin aggregate inlet of said outer shell.

13. A dryer drum coater as defined in claim 12, wherein said virgin aggregate inlet of said inner drum and said combustion products outlet are located near a first axial end of said dryer drum coater, and said vapor outlet is located near a second axial end of said dryer drum coater.

14. A dryer drum coater as defined in claim 12, further comprising a ductwork assembly having an inlet connected to said vapor outlet.

15. A dryer drum coater as defined in claim 14, wherein said ductwork assembly has an outlet connected to a combustion air inlet of said burner.

16. A dryer drum coater as defined in claim 15, further comprising a damper which is positioned in said ductwork assembly and which controls the flow of blue smoke through said ductwork assembly.

17. A dryer drum coater as defined in claim 14, further comprising a fan which draws blue smoke into said ductwork assembly from said vapor outlet.

* * * * *